US006298588B1

(12) United States Patent
Remitz et al.

(10) Patent No.: US 6,298,588 B1
(45) Date of Patent: Oct. 9, 2001

(54) CYLINDRICAL ADVERTISING COLUMN WITH ARTICLE CONTAINER

(75) Inventors: Hans-Jörg Remitz, Ritterhude; Marcus Kohne, Bremen, both of (DE)

(73) Assignee: Kohne Ingenieur büro, GmbH, Bremen (DE)

( * ) Notice: Subject to any disclaimer, the term of this patent is extended or adjusted under 35 U.S.C. 154(b) by 0 days.

(21) Appl. No.: 09/346,728

(22) Filed: Jul. 2, 1999

(30) Foreign Application Priority Data

Apr. 29, 1999 (DE) ..... 199 19 194

(51) Int. Cl.[7] ..... G09G 3/00

(52) U.S. Cl. ..... 40/431; 345/31

(58) Field of Search ..... 40/431, 430, 432, 40/433; 345/31

(56) References Cited

U.S. PATENT DOCUMENTS

| | | | | |
|---|---|---|---|---|
| 4,160,973 | * | 7/1979 | Berlin, Jr. | 340/755 |
| 4,689,604 | * | 8/1987 | Sokol | 340/755 |
| 5,057,827 | * | 10/1991 | Nobile et al. | 340/755 |
| 5,818,401 | * | 10/1998 | Wang | 345/31 |
| 6,115,006 | * | 9/2000 | Brotz | 345/31 |

* cited by examiner

*Primary Examiner*—Cassandra H. Davis

(57) ABSTRACT

A display apparatus combines a product display container and a plurality of light controlled light sources, wherein the light sources operate to create a visual image advertising the product.

21 Claims, 6 Drawing Sheets

CYLINDRICAL ADVERTISING COLUMN WITH ARTICLE CONTAINER

BACKGROUND OF THE INVENTION

1. Field of the Invention

The present invention concerns a display apparatus. More particularly, the present invention relates to a display apparatus having a plurality of light sources arranged on a movable carrier being driven by a drive device and a control device actuating, the plurality of light sources. These elements cooperate in such a manner as to create a recurring image that passes over a surface associated with the display apparatus.

2. Description of the Related Art

A conventional display apparatus is disclosed in WO 98/05023, which corresponds to U.S. patent application Ser. No. 09/230,246. This type of conventional display apparatus provides an image that may be visually perceived by an observer. The image may include image information, graphics or text information. This type of conventional display device find is ready application in retail establishments or other advertising venues. Within the conventional display apparatus, separately actuated light sources move together in a group on a movable carrier along a predetermined path or in relation to a surface associated with the display apparatus. The carrier may move from side-to-side in a swinging path or in a circular path. The carrier, and thus the mounted light sources, move at such a high speed that the observer perceives a stationary or a moving optical image generated by the light sources, without noticing the carrier. This result occurs because of the inertia in the human eye. Where the carrier and light sources move in a circular path the display device forms an electronic advertising column.

BRIEF SUMMARY OF THE INVENTION

In one aspect, the present invention is applied to the conventional display apparatus in such a way that it can be used to display advertising images in a more attractive and versatile manner. This object is obtained by use of a receiving device adapted to receive and secure an article that can also, in conjunction with the advertising image, be visually perceived by an observer.

At least in the case of a substantially electronic display apparatus, this receiving device according to the present invention becomes a constituent part of the display apparatus and permits further representation or perception of the article placed therein. The compound effect of image and article enhances the overall advertising effect for a broad class of products. Thus, by means of this article receiving device, the present invention allows an observer to perceive not only the electronically generated image, graphic, and/or text information but also the actual product, product design, model or other representation of the product. The present invention accordingly provides better product placement and advertising, as the arrangement of product with visual image compliment one another in a highly effective manner.

The display apparatus according to the present invention may be readily reused in a commercial setting by replacing the product in the receiving device and changing the electronically generated image. Thus, the inventive display apparatus for the first time combines an attractive product placement mechanism with a visually compelling electronic display to provide an effective advertising platform.

In one particularly preferred embodiment of the present invention, the receiving device takes the form of a container or receptacle. The container or receptacle is designed such that a product may be easily placed therein and subsequently removed and replaced by another product. As presently preferred, the container will have substantially cylindrical walls and a bottom. It is further preferred that the container be made of a transparent material which will be largely undetected by the observer, thus preserving the free-standing visual effect afforded by the electronically generated image.

In another aspect, the present invention provides that the receiving device be releaseably secured to the display apparatus. With this feature, the receiving device, together with the product contained therein, may be easily replaced in the display apparatus and the actual process of placing or mounting the product within the receiving device can be performed at the manufacturer.

In yet another aspect of the present invention, the advertising effect or attractiveness of the display apparatus is further enhanced by use of the receiving device in a manner which allows it to be moved or rotated by a drive mechanism. As the receiving device moves under the influence of the drive the product contained therein may be view from all sides. Product motion tends to further catch the observer's eye.

In still another aspect, the present invention provides an additional light source illuminating the product within the receiving device. This additional light source allows the product to be viewed regardless of the time of day and serves to further enhance product presentation.

When the display apparatus according to the present invention is used in the form of an electronic advertising column the light sources may be arranged on the carrier such that they are moved in a circular path. This arrangement allows the receiving, device, having a product placed therein, to be positioned within the circular path defined by the moving light sources on the carrier. In this way, the otherwise unused area inside the display apparatus of the electronic advertising column is put to good use as a product placement space. When so used, the present invention allows the product to be viewed from all sides and achieves a particular visual effect by virtue of the arrangement of the cylindrical surface on which the optical image is generated.

When used in the form of an electronic advertising column, the present invention may incorporate an external, transparent casing. This external casing may be secured and will thus serve as a protective casing. Preferably, the receiving device is suspended at an upper portion of the protective casing. Consistent with this purpose, the receiving device may be formed with radially projecting, flange-like projections that co-operate with the cylindrical protective casing at the upper edge thereof.

In yet another aspect, an alternate embodiment of the present invention provides that the receiving device includes a cover so that a product placed in the receiving device remains safe and protected.

BRIEF DESCRIPTION OF THE DRAWINGS

FIG. (FIG.) 1 is a diagrammatic perspective view of the a display apparatus according to the present invention.

DETAILED DESCRIPTION OF THE INVENTION

Figure 1:
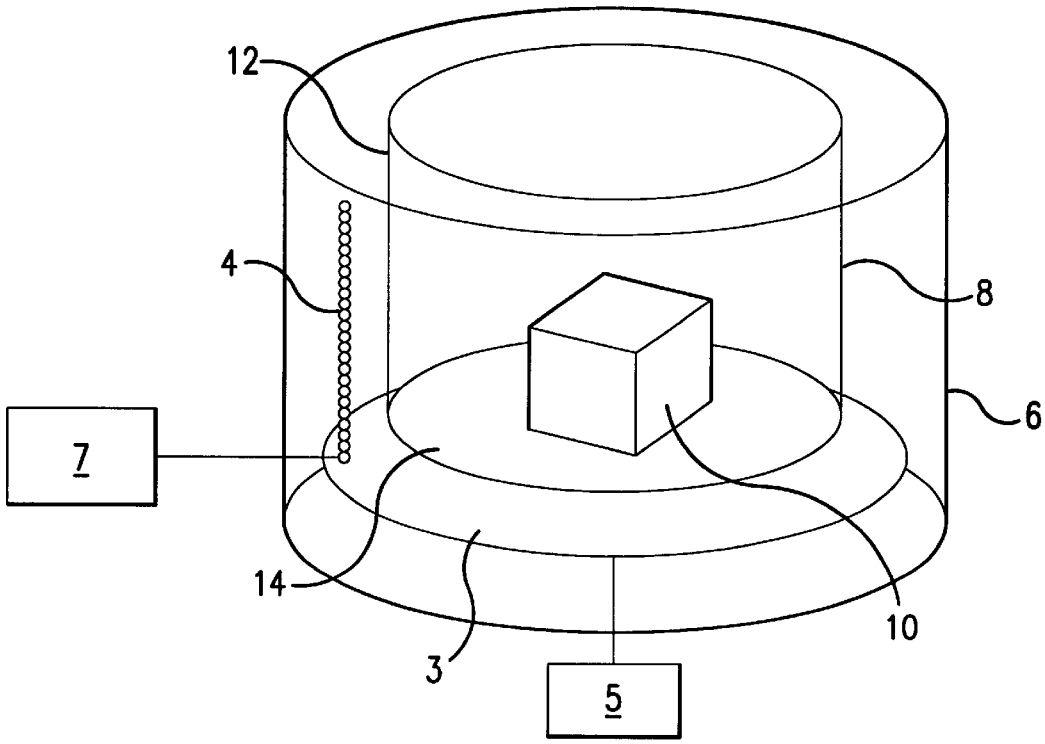
Figure 2:
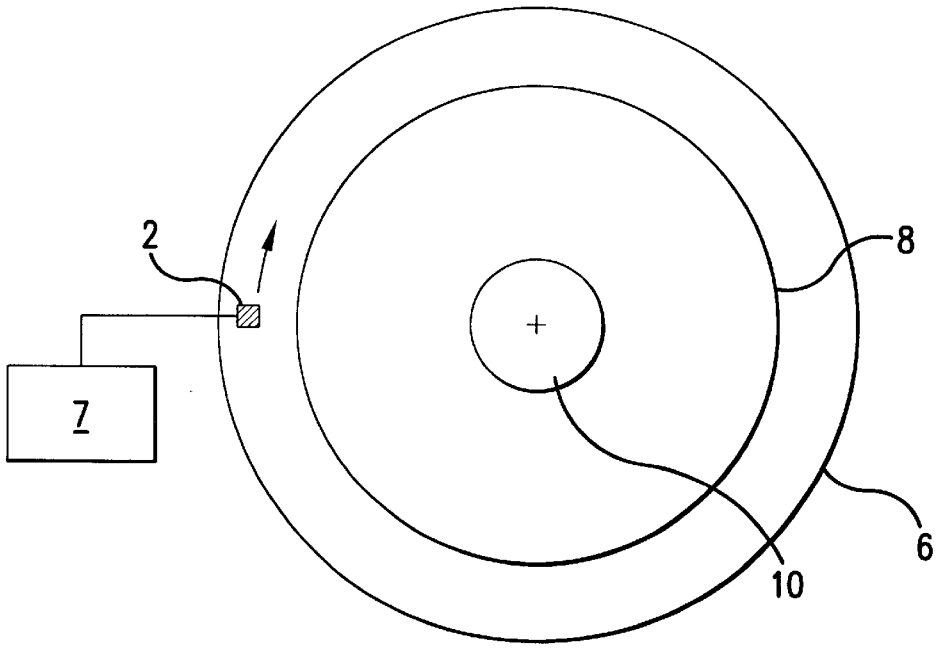
FIG. 2 is a plan view of the display apparatus shown in FIG. 1.

The display apparatus according to the present invention, as shown in FIGS. 1 and 2 comprises a carrier 2 and a plurality of light sources 4, in the form of light emitting diodes, which are arranged on carrier 2 in a mutually adjacent relationship and which can be rotated together with a drive disc 3 along a circular path at high speed by means of a drive device 5. In this arrangement, the plurality of light sources 4 defines a resulting image around a cylindrical surface.

By means of a control device 7, the individual light sources in the plurality of light sources 4 and the drive device 5 are controllable in such a way that an observer perceives a visual image containing images graphic, and text information. Yet, as discussed above, the carrier holding the plurality of light source 4 is not perceptible to the observer. The structure in principle and the mode of operation of such a display apparatus are described in U.S. patent application Ser. No. 09/230,246, the disclosure of which is incorporated herein by reference in its entirety to avoid repetition.

Carrier 2 is secured to drive disc 3 and arranged in a lower region of the display apparatus. A plurality of carriers 2, each having an associated plurality of light sources 4, might alternatively be arranged on drive disc 3. A stationary, external casing 6 formed from a transparent material such as glass or plastic affords protection to carrier 2 and the plurality of light sources 4. In the illustrated embodiment, the external casing 6 forms a cylindrical peripheral surface that protects the rotating carrier and plurality of light sources from an object intruding into the path of rotation. In some applications where a reduction in the air resistance to the rotational movement of carrier 3 and the plurality of light sources 4 is desired, the interior chamber formed by protective casing 6 may be evacuated to form a vacuum.

A receiving device 8 according to the present invention is arranged in the interior of the display apparatus and is adapted to receive a product 10. That is, as illustrated in FIGS. 1 and 2, receiving device 8 in the form of a container or receptacle is adapted to hold a product, such as a watch or clock. In similar manner, receiving device 8 may be designed to receive other articles such as printed advertisements, illustrations, additional products, text and the like. Receiving device 8, as illustrated in the specific embodiment, is made from a transparent material such as glass or plastic and has a cylindrical peripheral surface 12 and a circular bottom 14 on which the product 10 stands.

Receiving device 8 is arranged relative to carrier 2, the plurality of light sources 4 and drive disc 3 in such a way that there is no possibility of contact between these elements and receiving device 8. In the illustrated embodiment, receiving device 8 is suspended in the protective casing 6. For that purpose, in a manner not illustrated in FIGS. 1 and 2 but similar to the illustrations made in relation to the replaceable inserts 32 and 33 described hereafter, the receiving device 8 may utilize projections 36 (FIG. 7) or an annular flange 38 (FIG. 9) which radially protrudes in a flange-like configuration to contact the upper edge portion of the peripheral surface 12 of protective casing 6. In addition a cover (not shown) can cover receiving device 8 at the top so that product 10 is protected within. In addition, it is possible to achieve simple interchangeability of a receiving device 8 having product 10 mounted therein.

Figure 3:
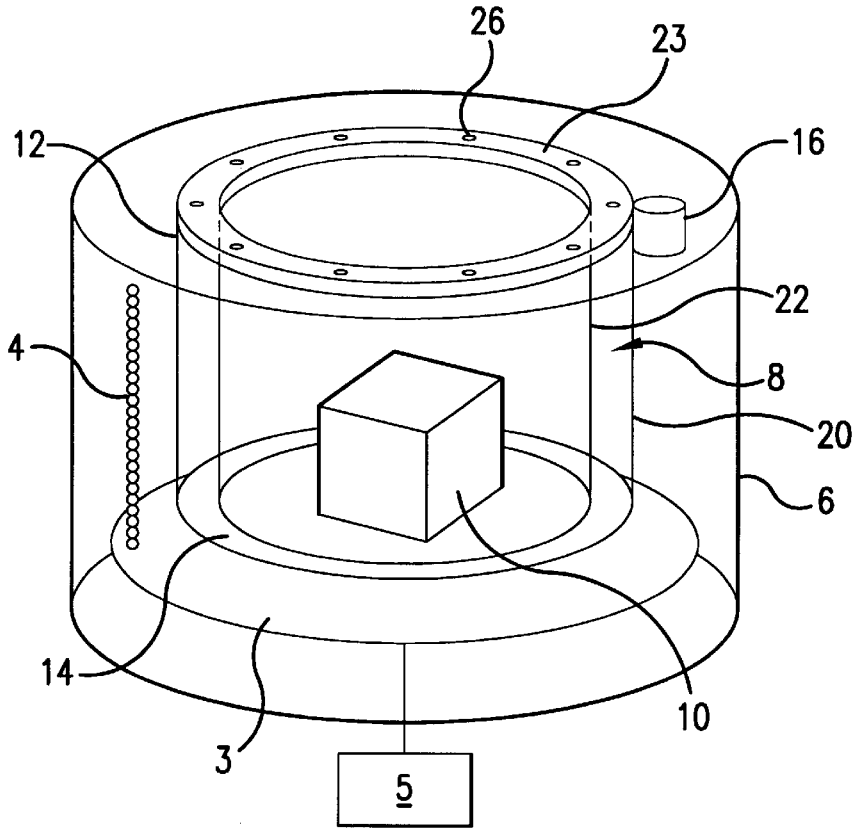
FIG. 3 is a perspective view of an alternate embodiment of a display apparatus according to the present invention with a rotatable receiving device.
Figure 4:
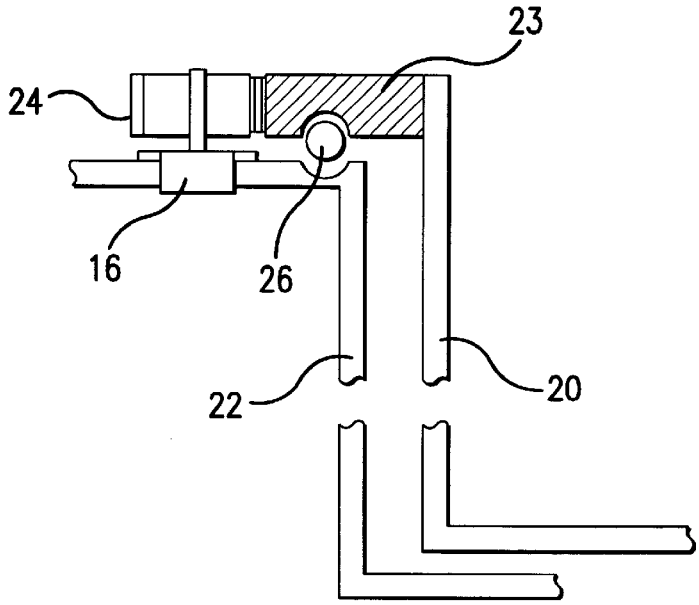
FIG. 4 is a sectional view of part of the embodiment shown in FIG. 3.

One manner of rotating, or otherwise moving, receiving device 8 within protective casing 6 is illustrated in FIGS. 3 and 4. As shown, receiving device 8 is preferably rotated at relatively slow speed by means of drive motor 16. In this embodiment, shown in FIG. 4, receiving device 8 has an outer (or first) container 20 and an inner (or second) container 22 into which product 10 is placed. Secured to the outer container 20 is a drive motor 16 that drives a drive gear 24. Inner container 22 comprises an outer edge portion 23 having another gear engaging drive gear 24. Containers 20 and 22 rotate relative one to another by means of a ball bearing assembly having a plurality of ball 26. With this arrangement, inner container 22 rotates when drive motor 16 is switched on.

Figure 5:
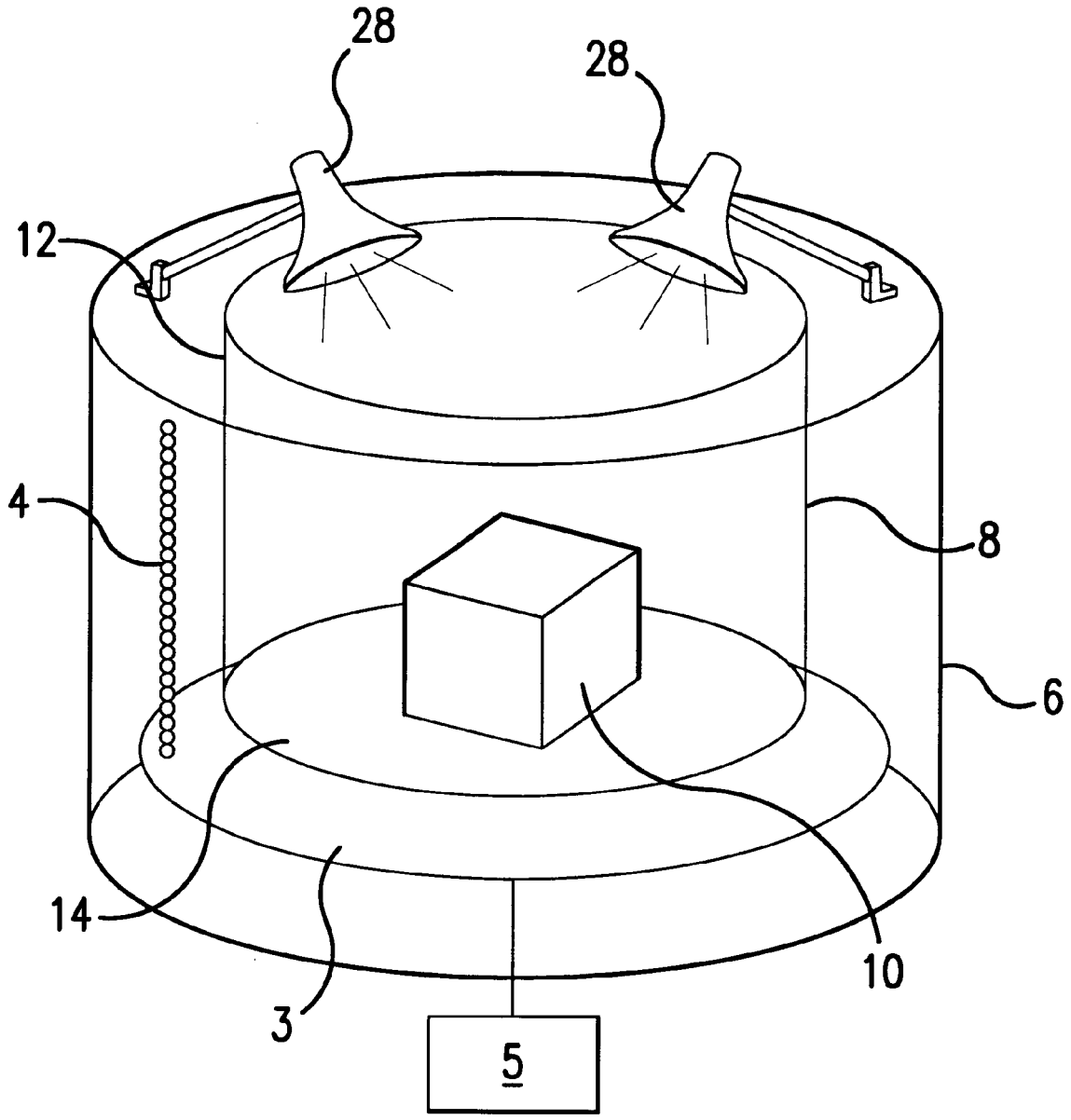
FIG. 5 shows a further alternative embodiment of the display apparatus with further light sources.

FIG. 5 diagrammatically illustrates another embodiment of the present invention in which additional light sources 28 are applied to the embodiment shown in FIG. 1. These additional light sources 28 illuminate product 10 and are arranged in the form of radiating devices in the upper region of the display apparatus.

Figure 6:
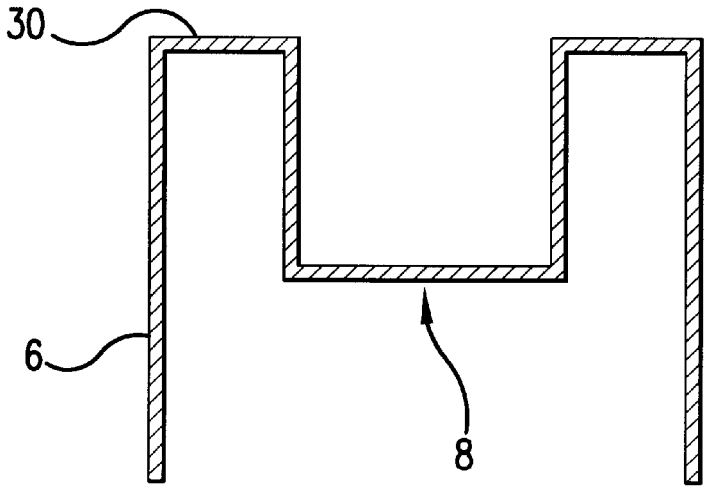
FIG. 6 is a sectional view of part of an alternative embodiment of a display apparatus according to the present invention.

FIG. 6 shows an embodiment that is very similar to the embodiment shown in FIG. 1 so that reference is made to the foregoing description. The external, protective casing 6 is formed in one piece with the receiving device 8, which is formed with an integral container or receptacle, having a cylindrical wall and a circular bottom formed therein. An annular flange portion 30 is provided as an upper portion of the container structure and connects protective casing 6 and receiving device 8. A product (not shown here) may be placed in the interior of the container.

Figure 7:
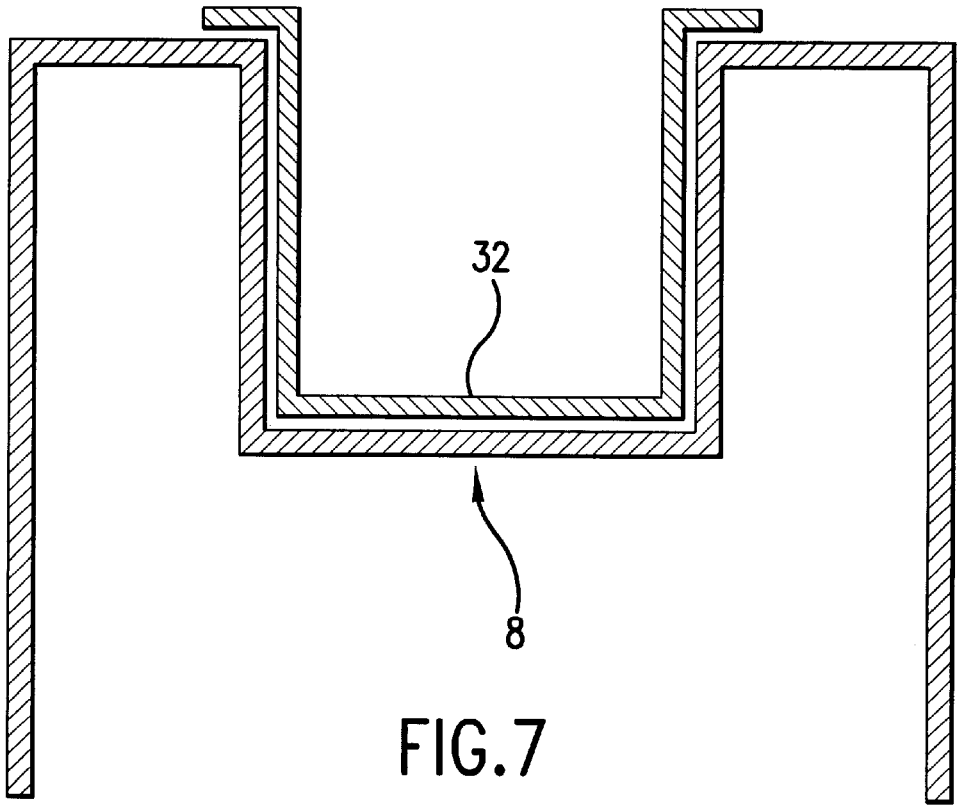
FIG. 7 is a sectional view of part of a further alternative embodiment.
Figure 8:
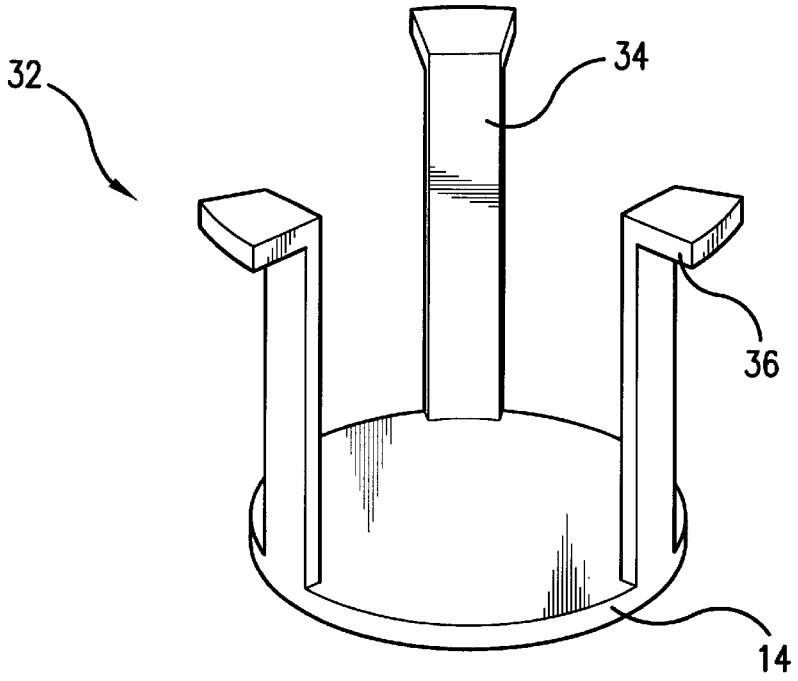
FIG. 8 shows a part of the embodiment of FIG. 7.

FIGS. 7 and 8 show an alternate embodiment that in addition to the embodiment shown in FIG. 6 includes a replaceable insert 32 that, as shown in FIG. 8, has three legs 34, each with a projection 36 such that insert 32 can be readily fit in a suspended position within receiving device 8. Legs 34 are connected to a circular bottom portion 14.

Figure 9:
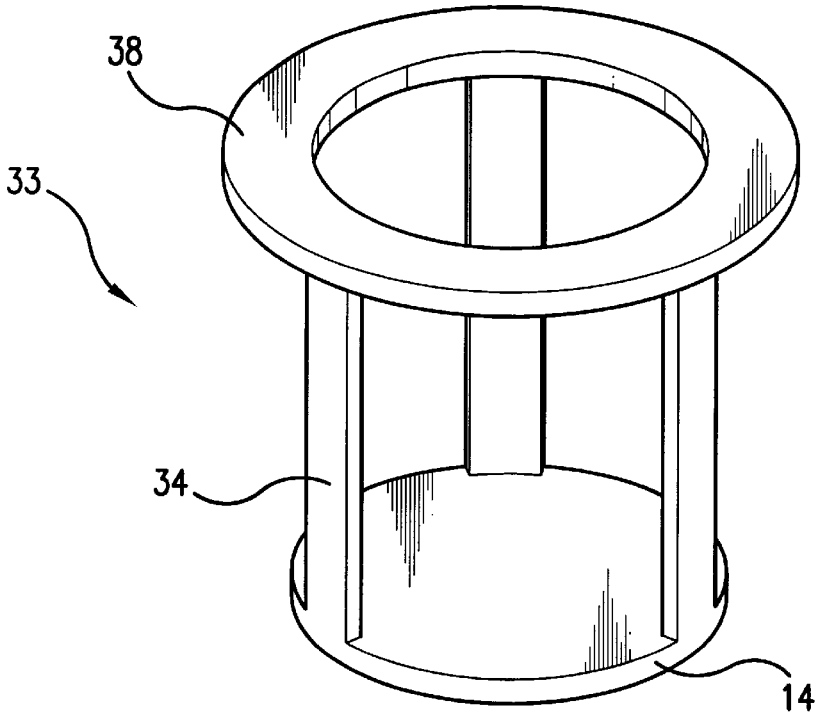
FIG. 9 is a perspective view of a further alternative embodiment.
Figure 10:
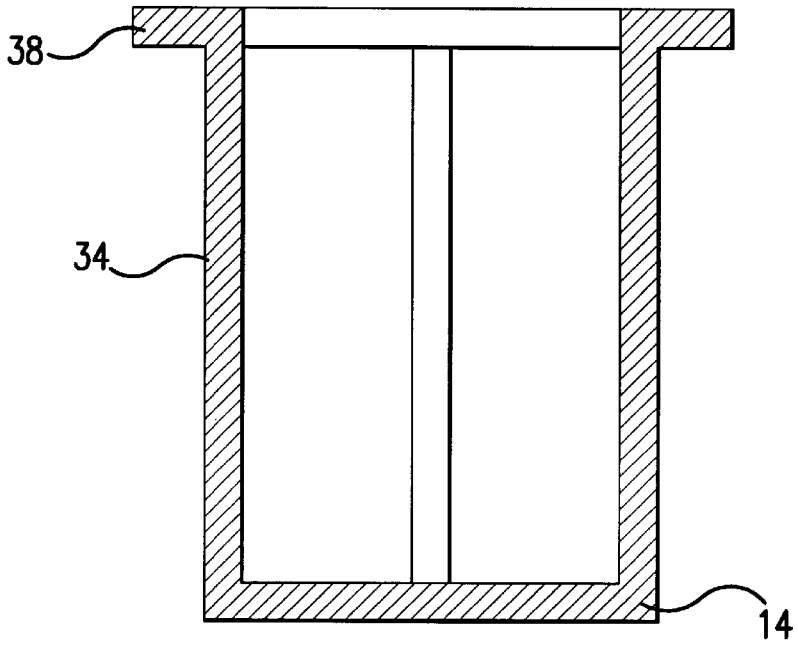
FIG. 10 is a sectional view of the embodiment illustrated in FIG. 9.

FIGS. 9 and 10 show an alternative insert 33 that also has three legs 34, but also an annular flange 38 connecting the legs.

Figure 11:
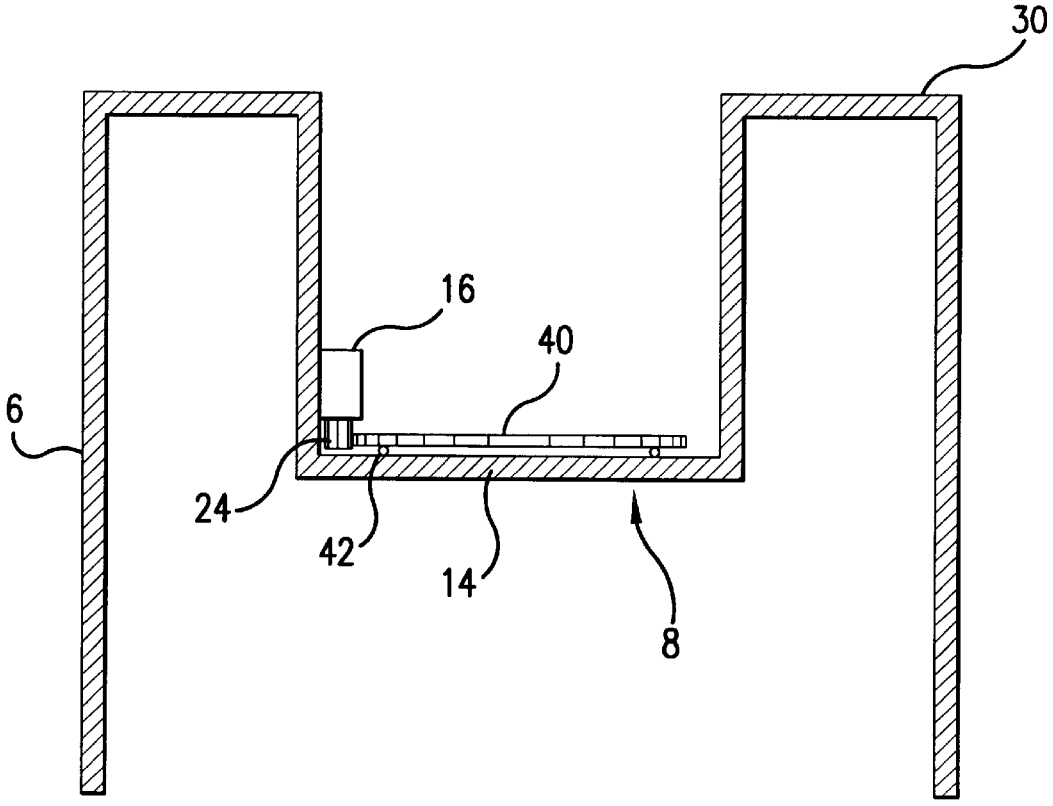
FIG. 11 shows a further alternative embodiment of a display apparatus with a drive.

The alternative embodiment shown in FIG. 11 constitutes a further development of the embodiment described with reference to FIG. 6, in that a disc 40 is rotated by means of another drive motor 16, a drive gear 24 mounted near the bottom portion 14, and a ball bearing assembly 42. Another gear adapted to engage drive gear 24 is provided on an outer edge of disc 40.

The following is a list of references numbers identifying elements shown in the drawings: carrier (2), drive disc (3), light emitting diodes (4), drive device (5), protective casing (6), receiving device (8), product (10), peripheral surface (12), bottom (14) drive motor (16), first container wall (20), second container wall (22), edge portion (23), drive gear (24), ball bearings (26), additional light sources (28), upper casing portion (30), first insert (32), second insert (33), legs (34), projection (36), flange (38), disc (40), and ball bearings (42).

What is claimed is:

1. A display apparatus, comprising:

a moveable carrier carrying a plurality of light sources;

a first drive device driving the moveable carrier, such that the plurality of light sources defines a cylindrical surface;

a control device selectively actuating the plurality of light sources, such that a recurring optical image is presented to a viewer on the cylindrical surface; and, the improvement comprising:

a receiving device placed within the cylindrical surface and adapted to receive an article such that the article may be perceived by the viewer.

2. The display device of claim 1, wherein the receiving device is independently moveable by means of a second drive device within the cylindrical surface.

3. The display device of claim 2, wherein the receiving device further comprises an inner cylinder wall and an outer cylinder wall, and wherein the second drive device comprises a motor frictionally connected between the inner and outer cylinder walls.

4. The display apparatus of claim 1, wherein the receiving device comprises a container into which the article may be placed.

5. The display apparatus of claim 4 wherein the container further comprises a cover.

6. The display apparatus of claim 4, wherein the container comprises a cylinder structure with a bottom.

7. The display apparatus of claim 4 or 5, wherein the container is formed of a transparent material.

8. The display apparatus of claim 1, 4, or 5 wherein the receiving device is adapted to be releasably secured to the display apparatus.

9. The display apparatus of claim 1, 4, or 5 wherein the receiving device is moveably driven by a second drive device.

10. The display apparatus of claim 1, 4, or 5 further comprising a light source illuminating the article.

11. The display apparatus of claim 1, further comprising:

a cylindrical, transparent protective casing encompassing the moveable carrier and supporting the receiving device.

12. The display apparatus of claim 11, wherein the receiving device is suspended from an upper edge of the protective casing.

13. The display device of claim 12, wherein the receiving device further comprises:

a bottom member adapted to receive the article;

a plurality of vertically disposed arms connected to the bottom member, each arm terminating in a radially projecting member, such that the receiving device is suspended by contact between the radially projecting members and the upper edge of the protective casing.

14. The display device of claim 11, wherein the receiving device is integrally formed with the protective casing.

15. The display device of claim 14, wherein the receiving device is a cylinder nested located within the protective casing and having at least one open end.

16. The display device of claim 15, wherein the receiving device is adapted to receive a replaceable insert.

17. The display device of claim 16, wherein the replaceable insert comprises a bottom member connected by a plurality of arms to an annular flange member designed to seat over the at one open end.

18. The display device of 15, further comprising one or more light source attached to a top portion of the protective casing and arranged to illuminate the article.

19. The display device of claim 15, wherein the receiving device further comprises a rotatable disc having an independent drive means located in a bottom of the nested cylinder.

20. A display apparatus, comprising:

a moveable carrier securing a plurality of light sources;

a control device actuating the plurality of light sources and a first drive device driving the moveable carrier, such that when the plurality of light sources are actuated on the moveable carrier as driven by the first drive device a recurring optical image is presented in a cylindrical surface to a viewer;

the improvement comprising:

a receiving device located within the cylindrical surface and adapted to receive an article such that the article may be perceived by the viewer.

21. The display device of claim 20, further comprising a transparent protective casing securely encompassing the cylindrical surface.

* * * * *